US012781966B2

(12) United States Patent
Clark et al.

(10) Patent No.: US 12,781,966 B2
(45) Date of Patent: Nov. 3, 2026

(54) GAS TURBINE ENGINE CONFIGURED FOR DECREASED DIFFUSER WINDAGE AND METHOD OF ASSEMBLING THE SAME

(71) Applicant: RTX Corporation, Farmington, CT (US)

(72) Inventors: Thomas E. Clark, Wells, ME (US); Andrew E. Breault, Bolton, CT (US); William K. Ackermann, East Hartford, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 18/639,359

(22) Filed: Apr. 18, 2024

(65) Prior Publication Data

US 2024/0353105 A1 Oct. 24, 2024

Related U.S. Application Data

(60) Provisional application No. 63/460,225, filed on Apr. 18, 2023.

(51) Int. Cl.
*F23R 3/60* (2006.01)
*F01D 5/08* (2006.01)
(Continued)

(52) U.S. Cl.
CPC ..... *F23R 3/60* (2013.01); *F01D 5/082* (2013.01); *F23R 3/002* (2013.01); *F23R 3/50* (2013.01); *F23R 2900/00017* (2013.01)

(58) Field of Classification Search
CPC ..... F01D 5/081; F01D 9/048; F01D 9/065; F01D 5/082; F23R 3/60; F23R 3/002; F23R 3/50; F23R 2900/00017
See application file for complete search history.

(56) References Cited

U.S. PATENT DOCUMENTS 8,336,317 B2 * 12/2012 Blanchard ..... F01D 5/082 60/806
10,018,360 B2 7/2018 Suciu
(Continued)

FOREIGN PATENT DOCUMENTS

GB 2589886 A 6/2021

OTHER PUBLICATIONS

EP Search Report for EP Patent Application No. 24171009.4 dated Jul. 16, 2024.

*Primary Examiner* — Devon C Kramer
*Assistant Examiner* — Henry Ng
(74) *Attorney, Agent, or Firm* — Getz Balich LLC

(57) ABSTRACT

A gas turbine engine is provided having an axial centerline, a compressor section, a turbine section, and a combustor section. The turbine section has a turbine first vane assembly that includes an annular first vane inner radial support. The combustor section has an outer casing, an annular combustor, and a unitary inner diffuser structure. The annular combustor has an inner radial flange. The unitary inner diffuser structure includes a compressor discharge, an inner diffuser case, and a tangential onboard injector (TOBI) inseparably attached to one another. The unitary inner diffuser structure further includes an outer radial flange and a TOBI connection flange. The annular FV inner radial support, the combustor inner radial flange, and the TOBI connection flange are secured to one another.

8 Claims, 5 Drawing Sheets

(51) Int. Cl.
*F23R 3/00* (2006.01)
*F23R 3/50* (2006.01)

(56) References Cited

U.S. PATENT DOCUMENTS

| | | | | |
|---|---|---|---|---|
| 10,422,237 | B2 | 9/2019 | Mcdavid | |
| 10,704,468 | B2 | 7/2020 | Suciu | |
| 11,773,773 | B1 * | 10/2023 | Mazur | F01D 5/046 60/751 |
| 2003/0079478 | A1 * | 5/2003 | Romani | F01D 5/081 60/785 |
| 2005/0022535 | A1 | 2/2005 | Palmisano | |
| 2008/0112798 | A1 | 5/2008 | Seitzer | |
| 2013/0071242 | A1 * | 3/2013 | Caprario | F16J 15/441 415/230 |
| 2013/0219917 | A1 * | 8/2013 | Suciu | F02C 7/185 60/785 |
| 2014/0290254 | A1 | 10/2014 | Manning | |
| 2015/0047359 | A1 * | 2/2015 | Maguire | F01D 5/08 60/726 |
| 2015/0241067 | A1 | 8/2015 | Jause | |
| 2016/0017755 | A1 | 1/2016 | Low | |
| 2016/0108748 | A1 * | 4/2016 | Harris | F01D 9/042 415/177 |
| 2016/0131037 | A1 * | 5/2016 | Spangler | F01D 25/08 60/806 |
| 2016/0153291 | A1 * | 6/2016 | Snyder | F01D 5/082 415/177 |
| 2016/0186606 | A1 * | 6/2016 | Blaney | F01D 25/12 415/116 |
| 2016/0215633 | A1 * | 7/2016 | Drake | F23R 3/04 |
| 2016/0312615 | A1 * | 10/2016 | Lyons | F02C 3/04 |
| 2017/0051751 | A1 * | 2/2017 | Ackermann | F04D 29/542 |
| 2018/0334961 | A1 * | 11/2018 | Hanrahan | F02C 7/185 |
| 2018/0347472 | A1 * | 12/2018 | Ortiz | F02C 7/143 |
| 2020/0141270 | A1 * | 5/2020 | Schwarz | F02C 6/08 |
| 2021/0003284 | A1 | 1/2021 | Fong | |
| 2021/0054753 | A1 * | 2/2021 | Prenter | F02C 7/18 |
| 2021/0102704 | A1 * | 4/2021 | Binek | B22F 10/40 |
| 2022/0018540 | A1 | 1/2022 | Prenter | |
| 2023/0066740 | A1 * | 3/2023 | Johnson | F01D 17/085 |
| 2024/0026822 | A1 * | 1/2024 | Jagata | F02C 7/18 |
| 2025/0198290 | A1 * | 6/2025 | Niergarth | F02K 3/06 |

* cited by examiner

GAS TURBINE ENGINE CONFIGURED FOR DECREASED DIFFUSER WINDAGE AND METHOD OF ASSEMBLING THE SAME

This application claims priority to U.S. Patent Appln. No. 63/460,225 filed Apr. 18, 2023 which is hereby incorporated herein by reference in its entirety.

BACKGROUND OF THE INVENTION

1. Technical Field

The present disclosure relates to gas turbine engines in general and to gas turbine engine diffusers, tangential onboard injectors, and first turbine vanes in particular.

2. Background Information

Gas turbine engines utilize a series of rotating airfoils alternating with static airfoils to compress and expand flow path air. The rotating stages must be supported by a static frame and shaft bearing system. In the core of the engine, a combustor spans a high-pressure compressor diffusor and a high-pressure turbine tangential onboard injector (TOBI). At mechanical interfaces within cavities that are exposed to both static and rotating structures, it is desired to limit windage (i.e., heat addition due to frictional losses). There may be significant aerothermal losses giving rise to cooling air heat addition between the compressor and turbine entrance due to rotational pumping of the cooling air against static structures. The rotating control volume of air may be perturbed by mechanical fasteners, discrete or asymmetric features on static components, which contribute to frictional aerothermal losses and heat pickup. Additionally, flow path gas temperatures are often above the operating metal temperature of most structural materials such that small increases in supply air temperature drive large reductions in component lives. This makes the task of effectively limiting windage a challenge for both turbine life and engine performance. Prior art solutions have employed segmented sheet metal windage covers or shields that affix to a bolted flange, and only partially shield the rotating control volume of air from the mechanical fasteners and attachment. Sheet metal shields have the advantage of being easily retrofitted to existing designs, however they cannot provide complete windage reduction as tooling access to the bolted flange is required for disassembly. Thus, sheet metal windage covers continue to suffer from windage.

SUMMARY

According to an aspect of the present disclosure, a gas turbine engine having an axial centerline is provided that includes a compressor section, a turbine section, and a combustor section. The turbine section has a turbine first vane assembly that includes an annular first vane inner radial support (annular FV inner radial support). The combustor section has an outer casing, an annular combustor, and a unitary inner diffuser structure. The annular combustor has an inner radial flange. The unitary inner diffuser structure includes a compressor discharge, an inner diffuser case, and a tangential onboard injector (TOBI) inseparably attached to one another. The unitary inner diffuser structure further includes an outer radial flange and a TOBI connection flange. The annular FV inner radial support, the combustor inner radial flange, and the TOBI connection flange are secured to one another.

In any of the aspects or embodiments described above and herein, the annular combustor may include an inner radial wall structure, wherein the inner diffuser case and the combustor inner radial wall structure define a portion of a diffuser inner diameter (ID) gas flow path. The annular FV inner radial support, the combustor inner radial flange, and the TOBI connection flange may be secured to one another by fasteners, with each fastener having a centerline. The fastener centerlines may be disposed outside of the diffuser ID gas flow path.

In any of the aspects or embodiments described above and herein, the annular FV inner radial support, the combustor inner radial flange, and the TOBI connection flange may be secured to one another at a coupling and the coupling may be disposed outside of a diffuser ID flow path.

In any of the aspects or embodiments described above and herein, the coupling may include a plurality of fasteners, with each fastener having a centerline that is disposed outside of the diffuser ID flow path.

In any of the aspects or embodiments described above and herein, the annular FV inner radial support, the combustor inner radial flange, and the TOBI connection flange may be secured to one another at a coupling and the coupling may be disposed outside of a leakage gas flow path disposed between the inner diffuser case and an aft compressor hub.

In any of the aspects or embodiments described above and herein, the coupling of the annular FV inner radial support, the combustor inner radial flange, and the TOBI connection flange may be disposed on an outer radial side of the TOBI.

In any of the aspects or embodiments described above and herein, the coupling includes a plurality of fasteners and the plurality of fasteners are disposed outside of the leakage gas flow path.

According to an aspect of the present disclosure, a gas turbine engine having an outer casing, and an axial centerline is provided that includes a compressor section, a turbine section, and a combustor section. The turbine section has a turbine first vane assembly module that includes an annular first vane inner radial support (annular FV inner radial support) coupled to a plurality of stator vanes. The combustor section has an annular combustor module and a unitary inner diffuser structure module. The annular combustor module having an inner radial flange. The unitary inner diffuser structure module including a compressor discharge, an inner diffuser case, and a tangential onboard injector (TOBI) inseparably attached to one another. The unitary inner diffuser structure module further includes an outer radial flange and a TOBI connection flange. The turbine first vane assembly module, the annular combustor module, and the unitary inner diffuser structure module are independent of one another are coupled to one another.

In any of the aspects or embodiments described above and herein, the annular combustor module may include an inner radial wall structure, wherein the inner diffuser case and the combustor inner radial wall structure define a portion of a diffuser inner diameter (ID) gas flow path. The inner diffuser case and an aft compressor hub may define a leakage gas flow path disposed there between. The turbine first vane assembly module, the annular combustor module, and the unitary inner diffuser structure module may be coupled to one another at a position outside of the leakage gas flow path.

In any of the aspects or embodiments described above and herein, the coupling of the turbine first vane assembly module, the annular combustor module, and the unitary inner diffuser structure module may be disposed on an outer radial side of the TOBI.

In any of the aspects or embodiments described above and herein, the coupling may be disposed outside of the leakage gas flow path.

According to an aspect of the present disclosure, a method of assembling gas turbine engine components is provided, the gas turbine engine having an aft compressor hub and an outer casing, the method comprising: providing an annular combustor module having an inner radial flange; providing a plurality of fuel nozzles; providing a unitary inner diffuser structure module that includes a compressor discharge, an inner diffuser case, and a tangential onboard injector (TOBI) inseparably attached to one another, and an outer radial flange and a TOBI connection flange; attaching the unitary inner diffuser structure module to the outer casing; attaching the plurality of fuel nozzles to the outer casing; and inserting the annular combustor module between the outer casing and the unitary inner diffuser structure module such that a portion of each fuel nozzle is engaged with a forward bulkhead of the annular combustor module, and the combustor module inner radial flange is engaged with the TOBI connection flange.

In any of the aspects or embodiments described above and herein, the method may include providing a turbine first vane assembly module that includes an annular first vane inner radial support (annular FV inner radial support) coupled to a plurality of stator vanes, and the method may include inserting the turbine first vane assembly module between the outer casing and the unitary inner diffuser structure module such that the annular FV inner radial support is engaged with the combustor module inner radial flange and the TOBI connection flange.

In any of the aspects or embodiments described above and herein, the annular combustor module may include an inner radial wall structure, wherein the inner diffuser case and the combustor inner radial wall structure define a portion of a diffuser inner diameter (ID) gas flow path. The inner diffuser case and an aft compressor hub may define a leakage gas flow path disposed there between. The turbine first vane assembly module, the annular combustor module, and the unitary inner diffuser structure module may be coupled to one another at a position outside of the leakage gas flow path.

In any of the aspects or embodiments described above and herein, the method may include providing a turbine first vane assembly module that includes an annular first vane inner radial support (annular FV inner radial support) coupled to a plurality of stator vanes, and may include coupling the turbine first vane assembly module with the annular combustor module prior to the annular combustor module being inserted between the outer casing and the aft compressor hub.

In any of the aspects or embodiments described above and herein, the insertion of the coupled turbine first vane assembly module and the annular combustor module may include engaging the annular FV inner radial support, the combustor module inner radial flange, and the TOBI connection flange with one another.

In any of the aspects or embodiments described above and herein, the method may further include providing a turbine first vane assembly module that includes an annular first vane inner radial support (annular FV inner radial support) coupled to a plurality of stator vanes, and inserting the turbine first vane assembly module between the outer casing and the aft compressor hub such that the annular FV inner radial support is engaged with the combustor module inner radial flange and the TOBI connection flange.

In any of the aspects or embodiments described above and herein, the annular combustor module may include an inner radial wall structure. The inner diffuser case and the combustor inner radial wall structure may define a portion of a diffuser inner diameter (ID) gas flow path. The inner diffuser case and the aft compressor hub may define a leakage gas flow path disposed there between. The engagement of the annular FV inner radial support, the combustor module inner radial flange, and the TOBI connection flange may be disposed at a position outside of the diffuser ID gas flow path and the leakage gas flow path.

In any of the aspects or embodiments described above and herein, the engagement of the annular FV inner radial support, the combustor module inner radial flange, and the TOBI connection flange may be disposed on an outer radial side of the TOBI.

In any of the aspects or embodiments described above and herein, the method may further include providing a turbine first vane assembly module that includes an annular first vane inner radial support (annular FV inner radial support) coupled to a plurality of stator vanes, and coupling the turbine first vane assembly module with the annular combustor module prior to the annular combustor module being inserted between the outer casing and the aft compressor hub.

In any of the aspects or embodiments described above and herein, the insertion of the coupled turbine first vane assembly module and the annular combustor module may include engaging the annular FV inner radial support, the combustor module inner radial flange, and the TOBI connection flange with one another.

The foregoing features and elements may be combined in various combinations without exclusivity, unless expressly indicated otherwise. For example, aspects and/or embodiments of the present disclosure may include any one or more of the individual features or elements disclosed above and/or below alone or in any combination thereof. These features and elements as well as the operation thereof will become more apparent in light of the following description and the accompanying drawings. It should be understood, however, the following description and drawings are intended to be exemplary in nature and non-limiting.

DETAILED DESCRIPTION

Figure 1:
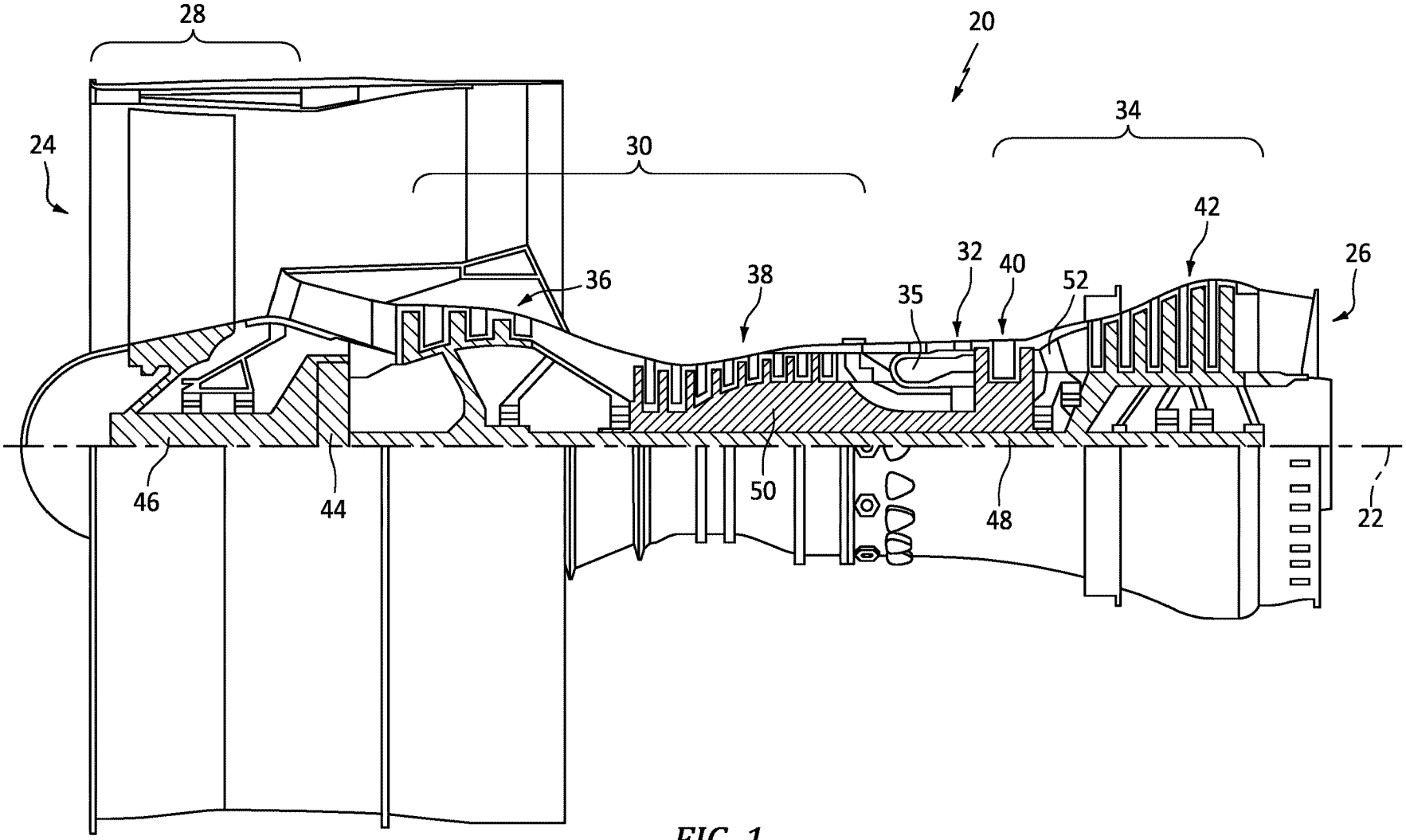
FIG. 1 is a diagrammatic sectional view of a gas turbine engine embodiment.

FIG. 1 shows a partially sectioned diagrammatic view of a geared gas turbine engine 20. The gas turbine engine 20 extends along an axial centerline 22 between an upstream airflow inlet 24 and a downstream airflow exhaust 26. The gas turbine engine 20 includes a fan section 28, a compressor section 30, a combustor section 32, and a turbine section 34. The combustor section 32 includes an annular combustor 35. The compressor section includes a low-pressure compressor (LPC) 36 and a high-pressure compressor (HPC) 38. The turbine section 34 includes a high-pressure turbine (HPT) 40 and a low-pressure turbine (LPT) 42. The engine sections are arranged sequentially along the centerline 22 within an engine housing. The fan section 28 is connected to a geared architecture 44, for example, through a fan shaft 46. The geared architecture 44 and the LPC 36 are connected to and driven by the LPT 42 through a low-speed shaft 48. The HPC 38 is connected to and driven by the HPT 40 through a high-speed shaft 50. The terms "forward", "leading", "aft, "trailing" are used herein to indicate the relative position of a component or surface. As air passes through the engine 20, a "leading edge" of a stator vane or rotor blade encounters the air before the "trailing edge" of the same. In a conventional axial engine such as that shown in FIG. 1, the fan section is "forward" of the compressor section and the turbine section is "aft" of the compressor section. The terms "inner radial" and "outer radial" refer to relative radial positions from the engine centerline. An inner radial component or path is disposed radially closer to the engine centerline than an outer radial component or path.

The gas turbine engine diagrammatically shown in FIG. 1 is an example provided to facilitate the description herein. The present disclosure is not limited to any particular gas turbine engine configuration, including the two-spool engine configuration shown, and may be utilized with single spool gas turbine engines as well as three spool gas turbine engines and the like.

During operation, air enters the gas turbine engine 20 through the airflow inlet 24 and may be directed through the fan section 28 and into a core gas path. The gas traveling along the core gas path is directed through the engine sections 30, 32, 34 and exits the gas turbine engine 20 through the airflow exhaust 26 to provide forward engine thrust. Within the combustor section 32, fuel is injected into a combustor 35 and mixed with compressed air. This fuel-air mixture is ignited to power the gas turbine engine 20. The non-combusted air and combustion products produced in the combustor 35 pass to the turbine section 34 where they power the turbine section 34.

Figure 2:
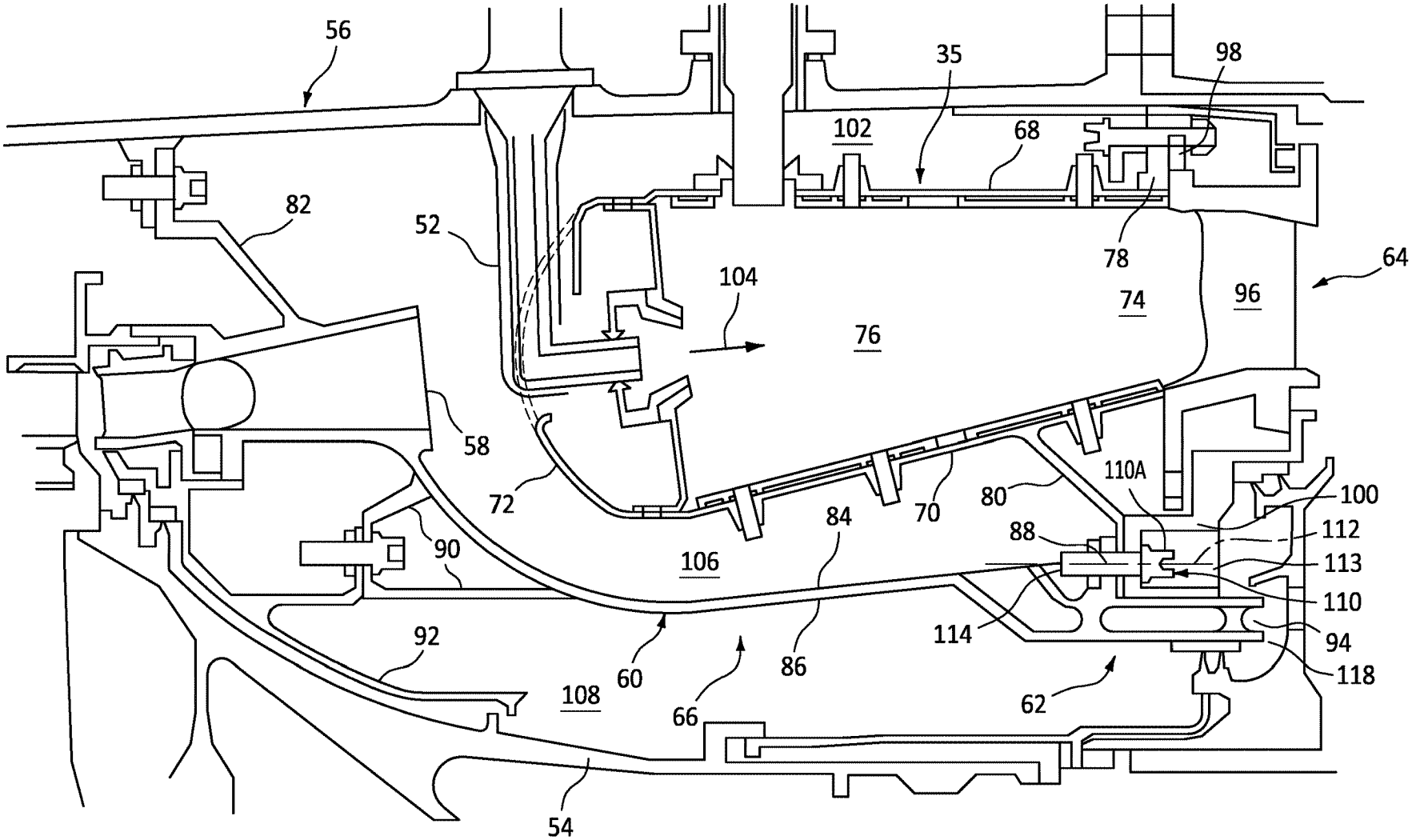
FIG. 2 is a diagrammatic partial view of a diffuser section embodiment of the present disclosure.

FIG. 2 is a diagrammatic cross-sectional partial view of a gas turbine engine 20 embodiment according to aspects of the present disclosure. FIG. 2 shows an annular combustor 35, a plurality of combustor fuel nozzles 52, an HPC aft hub 54, an outer casing 56, a HPC discharge 58, inner diffuser case 60, and tangential onboard injector ("TOBI") 62, and a turbine first vane assembly 64. The HPC discharge 58, inner diffuser case 60, and TOBI 62 are inseparably combined into a unitary structure, referred to hereinafter as the "unitary inner diffuser structure 66" or "UIDS 66". The HPC aft hub 54, outer casing 56, unitary inner diffuser structure 66, and turbine first vane assembly 64 are configured as annular structures.

The annular combustor 35 includes an outer radial wall structure 68, and inner radial wall structure 70, a forward bulkhead 72, an aft annular exit 74, a combustion chamber 76, an outer radial flange 78, and an inner radial flange 80. The combustion chamber 76 is defined by the inner and outer radial wall structures 70, 68, the forward bulkhead 72, and the aft annular exit 74. The outer radial flange 78, which may be a single circumferential flange or a plurality of circumferentially aligned flanges, extends radially outwardly from the outer radial wall structure 68 and is disposed proximate the aft annular exit 74. The inner radial flange 80 extends radially inwardly from the inner radial wall structure 70 and is disposed generally proximate the aft annular exit 74. The inner radial flange 80 includes a distal end that is configured for engagement with the unitary inner diffuser structure 66. A portion of each combustor fuel nozzle 52 is received within the forward bulkhead 72.

The UIDS 66 inseparably combines the HPC discharge 58, the inner diffuser case 60, and the TOBI 62. The UIDS 66 may therefore be described as having an HPC discharge portion 58, an inner diffuser case portion 60, and a TOBI portion 62. The UIDS 66 may be formed in a variety of different ways; e.g., as a weldment, a single casting, a single structure formed using an additive manufacturing technique, or the like. An outer radial flange 82 extends radially outwardly from the outer radial side of the HPC discharge portion 58 and up to the outer casing 56 for engagement therewith; e.g., mechanical attachment. The inner diffuser case portion 60 has an inner radial surface 84 and an outer radial surface 86. The UIDS 66 may include an inner radial flange 90. The inner diffuser case portion 60 extends radially inward and arcuately away from the HPC discharge portion 58 in an aft direction from the inner radial side of the HPC discharge portion 58. A TOBI connection flange 88 extends radially outwardly from the outer radial side of the TOBI portion 62. The UIDS 66 is configured as an annular structure extending around a circumference centered on the engine axial centerline 22.

An HPC leakage air containment structure 92 is attached to the inner radial flange 90. The containment structure 92 is spaced apart from the HPC aft hub 54.

The TOBI portion 62 of the UIDS 66 is integrally disposed at the aft end of the inner diffuser case portion 60. The TOBI portion 62 includes a plurality of nozzles 94 spaced apart from one another around the circumference of the TOBI portion 62. The TOBI portion 62 may be described as having an inner radial side and an outer radial side. The TOBI connection flange 88 extends radially outward from the outer radial side. In some embodiments, the TOBI portion 62 may include radial passages (not shown) disposed between adjacent nozzles 94, that extend between the inner radial side of the TOBI portion 62 to the outer radial side of the TOBI portion 62. As will be described herein, the TOBI portion 62 is configured to direct air through the nozzles 94 and that air may be further directed to a first HPT rotor stage (not shown) for cooling purposes.

The turbine first vane assembly 64 includes a plurality of first vane (FV) stator vanes 96, an annular FV outer radial support 98, and an annular FV inner radial support 100. The annular FV outer radial support 98 is configured for engagement with the outer casing 56. The annular FV inner radial support 100 is configured for engagement with the UIDS 66 and the combustor inner radial flange 80.

The outer casing 56, the combustor outer radial wall structure 68, the combustor inner radial wall structure 70, the inner diffuser case portion 60 of the UIDS 66, and the HPC aft hub 54 in various combinations define a plurality of gas flow paths through the diffuser section of engine and into the turbine section 34 of the engine 20. The outer casing 56 and the combustor outer radial wall structure 68 define an outer diameter ("OD") diffuser gas flow path 102 ("diffuser OD flow path 102") that is configured to contain/direct a portion of the gas exiting the HPC discharge 58. Another portion of the gas exiting the HPC discharge 58 that may be referred to as the "combustor primary flow" 104 follows a path through the combustor forward bulkhead 72 and into the combustion chamber 76 where it is mixed with fuel and the mixture combusted. The combustor inner radial wall structure 70 and the inner diffuser case portion 60 of the UIDS 66 define an inner diameter ("ID") diffuser gas flow path ("diffuser ID flow path 106") that is configured to contain/direct yet another portion of the gas exiting the HPC discharge portion 58 of the UIDS 66. At least some of the gas passing through the diffuser ID flow path 106 enters into the TOBI nozzles 94 and is eventually directed to the first HPT rotor stage (not shown). The inner diffuser case portion 60 of the UIDS 66 and the HPC aft hub 54 define a leakage gas flow path 108 that is configured to contain/direct leakage gas emanating from the inner diameter structure of an aft portion of the HPC. More specifically, the HPC leakage air containment structure 92 attached to the inner radial flange 90 of the inner diffuser case portion 60 of the UIDS 66 is spaced apart from a forward section of the HPC aft hub 54 and defines a gas path passage therebetween. Leakage gas passing through that gas path passage enters the leakage gas flow path 108 between the inner diffuser case portion 60 and the HPC aft hub 54.

As stated above, gas turbine engines utilize a series of rotor stages alternating with stator vane stages to compress flow path air. Some cavities disposed radially inward of the combustor 35 are configured as gas passages for handling leakage air or cooling air. A rotating control volume of air disposed within a cavity may be perturbed by features disposed within the cavity; e.g., mechanical fasteners, discrete or asymmetric features on static components, or the like. Similarly, discrete features on a rotating component can act as a pump. These flow perturbations can contribute to frictional aerothermal losses and heat pickup; i.e., windage. Gas temperatures within these cavities are often at or above the operating metal temperature of the structural materials defining the respective cavities. Even a relatively small increase in gas temperature can significantly, negatively affect the useful life of a component exposed to the high temperature gas. The present disclosure provides an improved structure and method that mitigates these issues.

The UIDS 66, the annular combustor 35, and the turbine first vane assembly 64 are three independent modules that decrease the number of features within the diffuser section relative to the number typically present within conventional diffuser sections. The UIDS 66 module, in particular, is configured to avoid or mitigate features that are apt to produce airflow perturbations in the diffuser section and consequent undesirable windage. These independent modules also greatly facilitate assembly. The HPC discharge 58, inner diffuser case 60, and TOBI 62 are inseparably combined into a unitary structure, referred to hereinafter as the "unitary inner diffuser structure 66" or "UIDS 66". The HPC aft hub 54, outer casing 56, unitary inner diffuser structure 66, and turbine first vane assembly 64 are configured as annular structures.

Figure 2A:
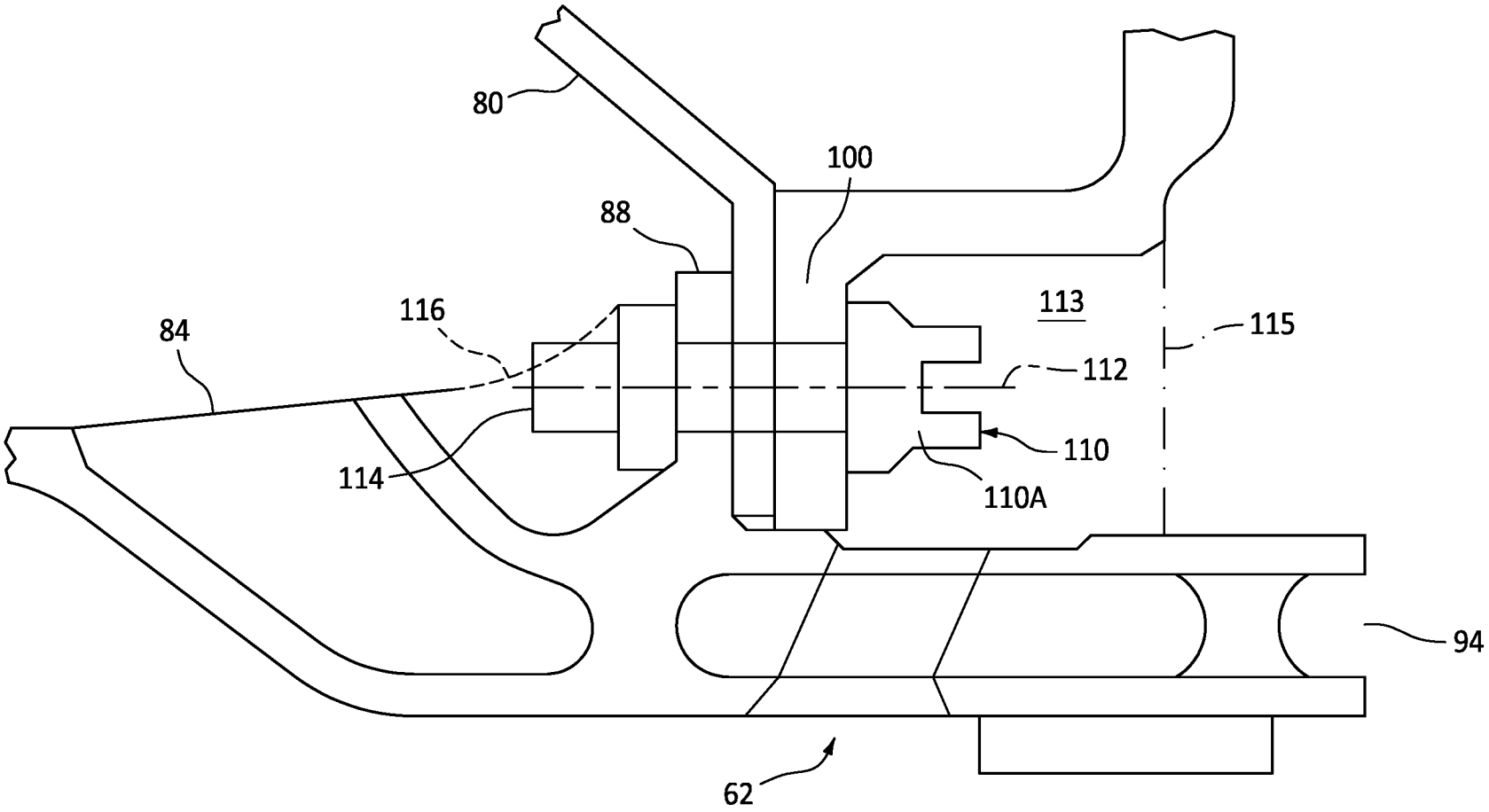
FIG. 2A is an enlarged view of a portion of the diffuser section embodiment shown in FIG. 2.

The UIDS module 66 includes two principal connection points: a) a forward connection point where the outer radial flange 82 connects with the outer casing 56; and b) an aft attachment point where the TOBI connection flange 88 engages with the annular FV inner radial support 100 and the combustor inner radial flange 80. As can be seen in the embodiment shown in FIG. 2, the UIDS module 66 is configured such that the fasteners 110 that create the connection between the TOBI connection flange 88, the annular FV inner radial support 100, and the combustor inner radial flange 80 extend minimally or not at all into the diffuser ID flow path 106. In an embodiment like that shown in FIGS. 2 and 2A, for example, the centerline 112 of the fastener 110 is disposed radially inside of an inner radial boundary of the diffuser ID flow path 106 and as a result only a small portion (e.g., less than half) of the fastener end surface 114 is exposed within the diffuser ID flow path 106. Proximate the fastener 110, the inner radial boundary of the diffuser ID flow path 106 may be defined by a phantom line 116 (see FIG. 2A) that continues the trajectory of the inner radial surface 84 of the inner diffuser case 60 in an aft direction. The fastener centerline 112 is disposed radially inside of the inner radial surface 84 and the phantom line 116. The connection between the TOBI connection flange 88, the annular FV inner radial support 100, and the combustor inner radial flange 80 may be referred to as a coupling of those elements. As can also be seen in the embodiment shown in FIG. 2, the connection between the TOBI connection flange 88, the annular FV inner radial support 100, and the combustor inner radial flange 80 is disposed on the outer radial side of the TOBI portion 62 of the UIDS 66 and significantly, the aforesaid connection is not disposed in either the diffuser ID flow path 106 or the leakage gas flow path 108 disposed between the inner diffuser case portion 60 of the UIDS 66 and the HPC aft hub 54. In addition, the head 110A of the fastener 110 is disposed within a cavity 113 (the opening of the cavity 113 diagrammatically defined by dashed line 115 as shown in FIG. 2A) portion of the rotating TOBI discharge cavity 118. Positioning the fastener heads 110A within the cavity mitigates the potential for airflow perturbations in the TOBI discharge cavity 118 and consequent undesirable windage therein.

The combustor module 35 includes three principal connection points: a) a forward connection point where the combustor fuel nozzles 52 are received within the forward bulkhead 72; b) an outer radial connection point where the combustor outer radial flange 78 and the annular FV outer radial support 98 engage with the outer casing 56; and c) an inner radial connection point where the combustor inner radial flange 80 engages with the annular FV inner radial support 100 and the TOBI connection flange 88.

The first turbine vane assembly module 64 includes two principal connection points: a) an outer radial connection point where the annular FV outer radial support 98 and the combustor outer radial flange 78 engage with the outer casing 56; and b) an inner radial connection point where the annular FV inner radial support 100 engages with the TOBI connection flange 88 and the combustor inner radial flange 80.

Conventional diffuser sections typically include an inner diffuser case structure that is independent of a TOBI. In these instances, the inner diffuser case structure and the TOBI are attached to one another by a circumferential array of fasteners disposed at one or more axial positions. These fasteners typically extend into the diffuser ID flow path disposed between the combustor inner radial wall structure 70 and the inner diffuser case, or into the leakage gas flow path disposed between the inner diffuser case and the HPC aft hub 54. Left uncovered, these fasteners create flow perturbations in the swirling air within the respective cavities, and consequent undesirable windage within the respective cavity. As described above, the windage issue has been historically addressed by using segmented sheet metal windage covers or shields that affix to a bolted flange. Also as described above, these solutions are less than optimum.

The unitary inner diffuser structure module 66, in contrast, eliminates the need for fasteners connecting the inner diffuser case 60 structure and the TOBI 62, and thereby eliminates the potential for such fasteners to create flow perturbations that can lead to undesirable windage. The elimination of such fasteners is also understood to provide an appreciable weight reduction and the benefits that stem therefrom.

Figure 4:
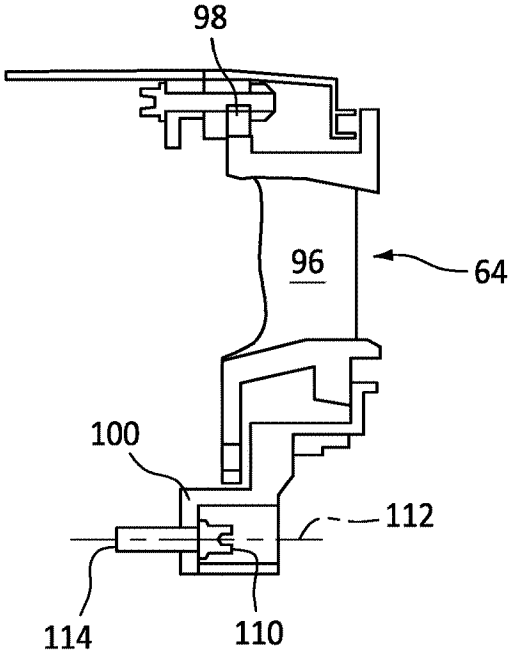
FIG. 4 is a diagrammatic view of a first turbine vane assembly module.
Figure 3:
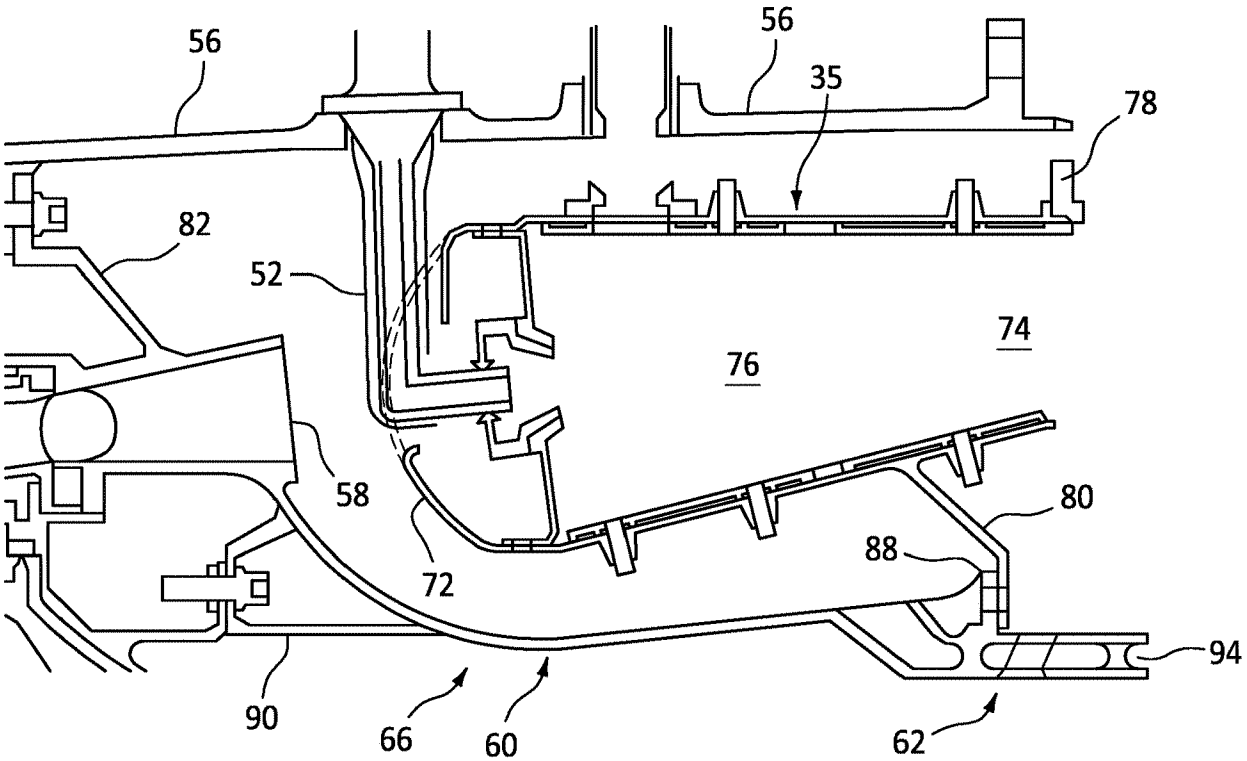
FIG. 3 is a diagrammatic partial view of a diffuser section embodiment of the present disclosure showing a unitary inner diffuser structure module and a fuel nozzle attached to the outer casing, and an annular combustor module engaged with the unitary inner diffuser structure module and the fuel nozzle.

The independent unitary inner diffuser structure module 66, combustor module 35, and first turbine vane assembly module 64 permit several assembly benefits. For example, FIGS. 3 and 4 diagrammatically illustrates a present disclosure method of assembly embodiment. In this embodiment, the unitary inner diffuser structure module 66 and the plurality of combustor fuel nozzles 52 are mounted to the outer casing 56. The annular combustor module 35 is subsequently inserted into the diffuser section between the outer casing 56 and the inner diffuser case portion 60 of the UIDS 66, with the combustor fuel nozzles 52 received within the forward bulkhead 72 of the annular combustor module 35, and the combustor inner radial flange 80 engaged with the TOBI connection flange 88; e.g., see FIG. 3. Subsequently, the first turbine vane assembly module 64 (see FIG. 4) may be installed at the aft annular exit 74 of the combustor module 35, with annular FV outer radial support 98 engaged with the outer casing 56 and the annular FV inner radial support 100 engaged with the combustor inner radial flange 80 and the TOBI connection flange 88 (e.g., FIG. 2 shows entire assembly).

Figure 5:
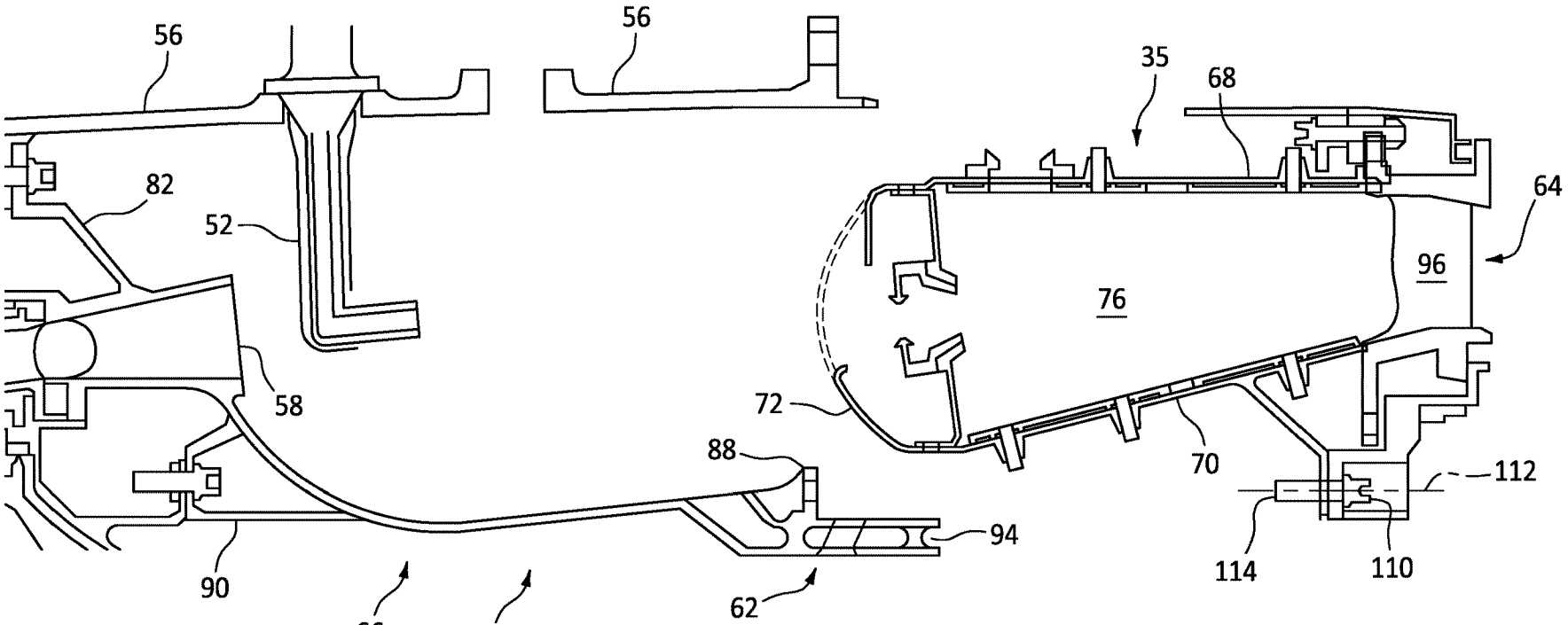
FIG. 5 is a diagrammatic partial view of a diffuser section embodiment of the present disclosure showing a unitary inner diffuser structure module and a fuel nozzle attached to the outer casing, and an annular combustor module and first turbine vane assembly module engaged with one another.

FIG. 5 diagrammatically illustrates an exploded view with a UIDS module 66 mounted to the outer casing 56 and an annular combustor module 35 and a first turbine vane assembly module 64 engaged with one another. FIG. 5 also shows a combustor fuel nozzle 52 mounted to the outer casing 56. In another present disclosure method of assembly embodiment, the UIDS module 66 (inseparably combining the HPC discharge portion 58, the inner diffuser case portion 60, and the TOBI portion 62) is mounted to the outer casing 56 (at the outer radial flange 82). The plurality of fuel nozzles 52 may be subsequently installed. The annular combustor module 35 and the first turbine vane assembly module 64 may be combined with one another, with the first turbine vane assembly module 64 disposed at the aft annular exit 74 of the annular combustor module 35, and the annular FV inner radial support 100 engaged with the combustor inner radial flange 80. The combined combustor module/first turbine vane assembly module 35, 64 may then be inserted into the diffuser section between the outer casing 56 and the inner diffuser case portion 60 of the UIDS 66, with the combustor fuel nozzles 52 received within the forward bulkhead 72 of the annular combustor module 35, the annular FV outer radial support 98 engaged with the outer casing 56, and the annular FV inner radial support 100 and combustor inner radial flange 80 engaged with the TOBI connection flange 88 (e.g., FIG. 2 shows entire assembly).

The present disclosure also provides benefits relating to leakage proximate the TOBI portion 62 of the UIDS 66. As can be seen in FIG. 2, a TOBI discharge cavity 118 is disposed aft of the TOBI nozzles. The TOBI discharge cavity 118 is sealed by a plurality of seals (e.g., knife edge seals) disposed on the inner radial side of the TOBI portion 62 and by a plurality of seals (e.g., knife edge seals) disposed on the outer radial side of the TOBI portion 62. The seals disposed on the outer radial side of the TOBI portion 62 are engaged with a seal member attached to the annular FV inner radial support 100. The stack up of the annular FV inner radial support 100, the combustor inner radial flange 80, and the TOBI connection flange 88 and the inner and outer radial sealing relative to the TOBI portion 62 help to prevent gas (e.g., non-swirled cooling air disposed in the diffuser ID flow path 106 and leakage gas disposed in the leakage gas flow path 108) from entering into the TOBI discharge cavity 118 and to partition cooling air zones.

While the principles of the disclosure have been described above in connection with specific apparatuses and methods, it is to be clearly understood that this description is made only by way of example and not as limitation on the scope of the disclosure. Specific details are given in the above description to provide a thorough understanding of the embodiments. However, it is understood that the embodiments may be practiced without these specific details.

It is noted that the embodiments may be described as a process which is depicted as a flowchart, a flow diagram, a block diagram, etc. Although any one of these structures may describe the operations as a sequential process, many of the operations can be performed in parallel or concurrently. In addition, the order of the operations may be rearranged. A process may correspond to a method, a function, a procedure, a subroutine, a subprogram, etc.

The singular forms "a," "an," and "the" refer to one or more than one, unless the context clearly dictates otherwise. For example, the term "comprising a specimen" includes single or plural specimens and is considered equivalent to the phrase "comprising at least one specimen." The term "or" refers to a single element of stated alternative elements or a combination of two or more elements unless the context clearly indicates otherwise. As used herein, "comprises" means "includes." Thus, "comprising A or B," means "including A or B, or A and B," without excluding additional elements.

It is noted that various connections are set forth between elements in the present description and drawings (the contents of which are included in this disclosure by way of reference). It is noted that these connections are general and, unless specified otherwise, may be direct or indirect and that this specification is not intended to be limiting in this respect. Any reference to attached, fixed, connected or the like may include permanent, removable, temporary, partial, full and/or any other possible attachment option.

No element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprise", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. For example, in the exemplary embodiments described above within the Detailed Description portion of the present specification, elements may be described as individual units and shown as independent of one another to facilitate the description. In alternative embodiments, such elements may be configured as combined elements. It is further noted that various method or process steps for embodiments of the present disclosure are described herein. The description may present method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible.

The invention claimed is:

1. A gas turbine engine having an axial centerline, comprising:

a compressor section;

a turbine section having a turbine first vane assembly that includes an annular first vane inner radial support (annular FV inner radial support); and a combustor section having an outer casing, an annular combustor, and a unitary inner diffuser structure, wherein the annular combustor has an inner radial flange, and wherein the unitary inner diffuser structure includes a compressor discharge, an inner diffuser case, and a tangential onboard injector (TOBI) inseparably attached to one another, the unitary inner diffuser structure further including an outer radial flange and a TOBI connection flange;

wherein the annular FV inner radial support, the inner radial flange, and the TOBI connection flange are secured to one another;

wherein the annular combustor includes an inner radial wall structure, and the inner diffuser case and the inner radial wall structure define a portion of a diffuser inner diameter (ID) gas flow path; and wherein the annular FV inner radial support, the inner radial flange, and the TOBI connection flange are secured to one another by couplings, the couplings are disposed inside a radially inner boundary of the diffuser ID gas flow path, the couplings are disposed outside of passages from the diffuser ID gas flow path into the TOBI, and the couplings are disposed axially aft of the passages at the inner diffuser case.

2. The gas turbine engine of claim 1, wherein the couplings include a plurality of fasteners, and wherein each of the plurality of fasteners has a centerline that is disposed inside the radially inner boundary of the diffuser ID gas flow path.

3. The gas turbine engine of claim 1, wherein the couplings are disposed radially outside of a leakage gas flow path disposed between the inner diffuser case and an aft compressor hub.

4. The gas turbine engine of claim 3, wherein the couplings are disposed on an outer radial side of the TOBI.

5. The gas turbine engine of claim 4, wherein the couplings comprise a plurality of fasteners.

6. A gas turbine engine having an outer casing, and an axial centerline, comprising:

a compressor section;

a turbine section having a turbine first vane assembly module that includes an annular first vane inner radial support (annular FV inner radial support) coupled to a plurality of stator vanes; and a combustor section having an annular combustor module and a unitary inner diffuser structure module, the annular combustor module having an inner radial flange, and the unitary inner diffuser structure module including a compressor discharge, an inner diffuser case, and a tangential onboard injector (TOBI) inseparably attached to one another, the unitary inner diffuser structure module further including an outer radial flange and a TOBI connection flange;

wherein the annular combustor module includes an inner radial wall structure, and the inner diffuser case and the inner radial wall structure define a portion of a diffuser inner diameter (ID) gas flow path; and wherein the turbine first vane assembly module, the annular combustor module, and the unitary inner diffuser structure module are independent of one another and are coupled to one another at couplings disposed radially inside of the diffuser ID gas flow path, the couplings are disposed outside of passages from the diffuser ID gas flow path into the TOBI, and the couplings are disposed axially aft of the passages at the inner diffuser case.

7. The gas turbine engine of claim 6, wherein the inner diffuser case and an aft compressor hub define a leakage gas flow path disposed therebetween; and wherein the couplings are disposed radially outside of the leakage gas flow path.

8. The gas turbine engine of claim 7, wherein the couplings are disposed on an outer radial side of the TOBI.

* * * * *